US007272237B2

(12) United States Patent
Linn et al.

(10) Patent No.: US 7,272,237 B2
(45) Date of Patent: Sep. 18, 2007

(54) AUDIO SPEAKER HAVING A REMOVABLE VOICE COIL

(75) Inventors: Aaron Linn, York, ME (US); Leif Blackmon, Medfield, MA (US)

(73) Assignee: Boston Acoustics, Inc., Peabody, MA (US)

( * ) Notice: Subject to any disclaimer, the term of this patent is extended or adjusted under 35 U.S.C. 154(b) by 569 days.

(21) Appl. No.: 10/446,298

(22) Filed: May 28, 2003

(65) Prior Publication Data

US 2004/0240700 A1 Dec. 2, 2004

(51) Int. Cl.
*H04R 25/00* (2006.01)

(52) U.S. Cl. ..... 381/396; 381/398; 381/400

(58) Field of Classification Search ..... 381/407, 381/400, 403–405, 401, 410, 398, 396
See application file for complete search history.

(56) References Cited

U.S. PATENT DOCUMENTS 4,118,695 A 10/1978 Ogawa et al.
6,088,466 A 7/2000 Proni
6,675,931 B2 1/2004 Sahyoun ..... 181/157

OTHER PUBLICATIONS

International Search Report from corresponding International Application No. PCT/US04/03168, filed Feb. 3, 2004.

*Primary Examiner*—Curtis Kuntz
*Assistant Examiner*—Tuan Duc Nguyen
(74) *Attorney, Agent, or Firm*—Peter A. Nieves; Sheehan, Phinney, Bass & Green, P.A.

(57) ABSTRACT

An audio speaker having a removable voice coil, which may be a part of a voice coil assembly. The voice coil may be user-removable to facilitate replacement of a damaged voice coil or reconfiguration of a speaker system. Properly positioning the voice coil assembly may provide a solder-free electrical connection between the voice coil and leads that provide current to the voice coil. In some embodiments, the voice coil is user-removably attached to an inner circumferential surface of a diaphragm. In other embodiments, the voice coil is connected to the diaphragm, and the voice coil assembly and the diaphragm are both user-removably attached to a frame.

25 Claims, 7 Drawing Sheets

300

AUDIO SPEAKER HAVING A REMOVABLE VOICE COIL

BACKGROUND OF INVENTION

1. Field of Invention

The present invention is directed to voice coil-actuated audio speakers, and more particularly to voice coil-actuated audio speakers having removable voice coils.

2. Discussion of Related Art

Many conventional audio speakers (also referred to herein simply as speakers) include diaphragms actuated by voice coils. For example, low frequency sound transducers (i.e. woofers) are typically comprised of such voice coil-actuated diaphragms. FIG. 1 is a cross-sectional side view of a conventional audio speaker 100 having a diaphragm 110 actuatable using a voice coil 122. Voice coil 122 comprises a wire which is wrapped about a substrate 124. The voice coil and substrate comprise a voice coil assembly 120.

Audio speaker 100 includes a voice coil drive system having an impedance rating. The drive system is comprised of an amplifier 113, and leads 130 to provide a current signal from the amplifier to voice coil 122. Voice coil 122 is maintained in a magnetic field provided by a magnet 140 and a pole 150, such that voice coil 122 and diaphragm 110 are actuated in response to the current signal. Actuation of diaphragm 110 produces an audio output. Voice coil 122 has an impedance suitable for use with the drive system.

A spider 160 (also commonly referred to as a suspension) operates to return diaphragm 110 to its initial position after and during actuation, and a frame 170 supports diaphragm 110. Frame 170 is connected to diaphragm 110 using a surround 180. A dust cap 190 is provided to protect voice coil 122.

Assembly of a conventional speaker system, such as speaker system 100, typically requires the performance of accurate assembly steps, many of which require special tools to complete. FIG. 2 is a cross-sectional side view of a partially assembled speaker system 100' (with dust cap 190 shown in FIG. 1 removed). During assembly, a gap alignment device 210 is positioned to accurately maintain a gap $g_1$ between pole 150 and voice coil assembly 120 while diaphragm 110 is attached to voice coil assembly 120 (at location 112), surround 180 is attached to frame 170 (at location 172), and spider 160 is attached to frame 170 (at location 162) and to diaphragm 110 (or voice coil assembly 120).

Each of the attachments is made using a permanent adhesive, such as an epoxy, to ensure that each attachment will remain secure during the lifetime of the audio speaker. After the adhesive cures, gap alignment device 210 is removed and dust cap 190 (illustrated in FIG. 1) is secured in place. In the resulting structure, the voice coil assembly 120 is supported by frame 170 in a manner such that the voice coil assembly 120 is centered about pole 150 (i.e., gap $g_1$ is uniform about pole 150). Accordingly, during subsequent operation of the speaker system 100' (i.e., during actuation of voice coil assembly 120 and diaphragm 110) voice coil assembly 120 moves without mechanical interference from pole 150.

An additional concern when assembling speaker system 100' is providing an appropriate electrical connection between amplifier 113 and voice coil 122 so that the voice coil will be properly actuated. For example, the electrical connection must have an accurate impedance. Typically, to achieve an accurate impedance, leads 130 must be made of an appropriate material, have accurate lengths, and must be precisely soldered to the ends of voice coil 122.

In typical field use, damage to a voice coil is a common source of failure of voice coil-actuated speaker systems, such as audio speaker system 100 in FIG. 1. Voice coil damage may be acute (i.e., resulting from a single occurrence of excessive current), may be cumulative (i.e., resulting from excessive drive current over a lifetime), or some combination of both.

Despite the fact that voice coil damage is a common source of failure, there has been no convenient way to replace a voice coil 122 (or voice coil assembly 120). Replacement has been complicated by the need to remove one or more of the permanently-mounted components of a speaker, any or all of which may be damaged during the process, and the need to re-assemble the audio speaker (having a new voice coil) using the accurate assembly steps and specialized tools as described above. Because of these complications, repair of an audio speaker having a damaged voice coil typically requires taking the speaker system to a speaker repair shop or otherwise obtaining the services of a technician having any necessary tools and know-how.

Further, in many instances, even the process of getting a damaged speaker to a repair shop is an inconvenience. For example, many conventional systems are mounted in fixtures (e.g., a wall or ceiling of a building, or a dashboard, rear deck, or door of a car) such that a damaged speaker system may need to be removed from the fixture before repair can occur. For the above reasons, repairing a speaker having a damaged voice coil may require significant effort, down-time, and/or expense.

SUMMARY OF INVENTION

Aspects of the present invention are directed to an audio speaker having a removably attached voice coil. A removably attached voice coil may be user-removable, thus permitting user-replacement of a damaged audio speaker system with minimal effort, down-time and/or expense. The term "removable" is defined herein to mean disengagable without damage to the component to be removed and without damage to other components; however it does not preclude the use of a sacrificial attachment device which may be damaged during removal. The term "user-removable" is defined herein to mean removable without specialized tools. For example, a screwdriver, pliers and a hammer are not specialized tools. The term "user-replaceable" means removable and assemblable with gap alignment device, soldering equipment, a heat device to cure an adhesive, or a chemical activator to cure an adhesive.

For example, some aspects of the invention are directed to an audio speaker, comprising: a frame; a diaphragm having an outer circumferential surface attached to the frame; and a voice coil assembly comprising a voice coil, the voice coil assembly being user-removably attached to the frame. In some embodiments, the voice coil assembly is user-removably attached to an inner circumferential surface of the diaphragm. In other embodiments, the voice coil assembly is connected to the diaphragm, and the voice coil assembly and the diaphragm are both user-removably attached to the frame.

Other aspects of the present invention are directed to reconfigurability of an (undamaged) audio speaker having a removably attached voice coil. Reconfigurability of a speaker having a removably attached voice coil provides increased versatility for a speaker by simplifying the process of removing a first voice coil and replacing it with a second voice coil. For example, during the course of a lifetime of a given audio speaker, it may be desirable to use voice coils having different impedances.

Still other aspects of the present invention are directed to the reconfigurability of speaker systems comprised of one or more audio speakers having removably attached voice coils. For example, it may be desirable to reconfigure a speaker system having a drive system and a first audio speaker driven by the drive system, by adding a second audio speaker also to be driven by the drive system. Adding the second audio speaker may make it necessary or desirable to replace the voice coil of the first audio speaker with a different voice coil, having a different impedance, such that the total impedance of the first audio speaker and the second audio speaker is suitable for use with the drive system.

It is also to be appreciated that the removability aspect of a voice coil may make it possible to maintain a reduced inventory of fully assembled speaker systems (e.g., by a manufacturer, a wholesaler, a retailer or end-user) because a configurable speaker subassembly (e.g., a speaker system including all but a voice coil) may be maintained, along with a selection of voice coils (having a variety of impedances). A voice coil having a selected impedance may be added to a selected speaker subassembly once a desired voice coil impedance is selected based on the application for which the speaker is to be used. Such an approach may lead to reduced space requirements and reduced dollar-value of an inventory.

A first aspect of the invention is directed to an audio speaker, comprising a frame; a diaphragm having an outer circumferential surface attached to the frame, and an inner circumferential surface; and a voice coil assembly comprising a voice coil, the voice coil assembly being user-removably attached to the inner circumferential surface of the diaphragm. In some embodiments, the audio speaker further comprises a collar connected between the diaphragm and the voice coil assembly, the collar having an outer surface attached to the inner circumferential surface of the diaphragm, the collar adapted to removably receive the voice coil assembly. The voice coil assembly may further comprise a substrate about which the voice coil is wrapped.

In some embodiments, the voice coil assembly attaches to an interior surface of the collar. Optionally, the collar may be adapted to slidably engage the voice coil assembly. In some embodiments, the audio speaker further comprises a pole, wherein the collar has a surface centered relative the pole. Additionally, the voice coil assembly may mechanically contact the interior surface such that the voice coil is centered about the pole.

In some embodiments, the collar comprises a fastening mechanism. In such embodiments, the collar may be adapted to receive a fastener. In some embodiments, the fastening mechanism comprises one of a snap fit mechanism and press fit mechanism such that a fastener may not be necessary.

Optionally, the collar may have an electrical contact attached thereto. In some embodiments the fastener electrically connects the voice coil to the electrical contact. In some embodiments, the collar has a conductive line electrically coupled to the electrical contact, and integrated with the collar. The collar may be integrated with the diaphragm.

The voice coil assembly may comprise an interface attached to the interior surface of the collar, and attached to the substrate. Optionally, the interface has at least one electrical contact attached thereto. The interface may have a conductive line electrically coupled to the electrical contact, and integrated with the interface.

Another aspect of the invention is an apparatus for use in an audio speaker, comprising a collar having an outer surface adapted to attach to an inner surface of a diaphragm, and an inner circumferential surface adapted to removably receive a voice coil assembly including a voice coil, and to position the voice coil assembly in a predetermined alignment. In some embodiments, the inner surface of the collar may be adapted to slidably engage the voice coil assembly. Optionally, the inner surface is adapted to center the voice coil about a pole of the audio speaker. The apparatus may comprise at least one electrical contact attached to the collar, and adapted to electrically connect to the voice coil assembly. The apparatus may include a conductive line electrically coupled to the at least one electrical contact. The conductive line may be integrated with the collar and adapted to contact a lead to provide current to the voice coil.

Another aspect of the invention is a voice coil assembly for use in an audio speaker, comprising a voice coil; and an interface attached to the voice coil and adapted to attach to a collar of the audio speaker, the interface being adapted to be removably received and aligned in a predetermined position relative to a surface of the collar. The voice coil assembly may comprise a substrate about which the voice coil is wrapped, the substrate connected to the interface. The substrate and the interface may be integrated to form a single component. The voice coil assembly may comprise electrical contacts configured and arranged to electrically connect to the collar. In some embodiments, the electrical contacts are attached to the interface.

In some embodiments, the voice coil assembly may further comprise a fastening mechanism to attach the voice coil assembly to the collar. Optionally, the fastening mechanism is adapted to receive a fastener. Alternatively, the fastening mechanism may comprise one of a snap fit mechanism and press fit mechanism. In some embodiments, the audio speaker includes a diaphragm that is integrated with the collar. The interface may have at least one conductive line electrically connected to at least one of the electrical contacts, the at least one conductive line being integrated with the interface.

Another aspect of the invention is an audio speaker subassembly, comprising a frame; a diaphragm connected to the frame; and a collar connected to the diaphragm, the collar being adapted to removably receive a voice coil assembly.

Yet another aspect of the invention is an audio speaker, comprising a frame; a diaphragm connected to the frame; a voice coil; and a collar attached to the diaphragm, the collar having a fastening mechanism configured and arranged to removably attach the voice coil to the collar. The voice coil may be wrapped about a substrate to form a voice coil assembly. The collar may be adapted to removably receive the voice coil assembly. In some embodiments, the collar is adapted to slidably engage the voice coil assembly. In some embodiments, the audio speaker has a front from which sound is projected, and the voice coil assembly slides in from the front of the audio speaker.

Another aspect of the invention is a voice coil assembly for use in an audio speaker having a magnet and a pole, comprising a voice coil; and an interface attached to the voice coil and adapted to be attached to the audio speaker, the interface being adapted to be removably received and aligned in a predetermined position relative to the magnet and pole. In some embodiments, the voice coil assembly further comprises a substrate about which the voice coil is wrapped, the substrate connected to the interface. The voice coil assembly may further comprise electrical contacts configured and arranged to electrically connect to an amplifier. In some embodiments, the voice coil assembly further comprises a fastening mechanism to attach the voice coil assembly to the audio speaker. Optionally, the fastening mechanism is adapted to receive a fastener. Alternatively, the fastening mechanism may comprise one of a snap fit mechanism and press fit mechanism.

Another aspect of the invention is an audio speaker, comprising: a speaker subassembly comprising a frame and a voice coil mount; a diaphragm having an outer circumferential surface attached to the frame; and a voice coil assembly comprising a voice coil, the voice coil assembly connected to the diaphragm, and the voice coil assembly and the diaphragm both being user-removably attached to the speaker subassembly.

Another aspect of the invention is an audio speaker, comprising: a speaker subassembly comprising a frame and a voice coil mount; a diaphragm having an outer circumferential surface attached to the frame; and a voice coil assembly comprising a voice coil, the voice coil assembly connected to the diaphragm, and the voice coil assembly and the diaphragm both being user-removably attached to the speaker subassembly. In some embodiments, the diaphragm and the voice coil assembly are connected together. In some embodiments, the voice coil assembly further comprises a substrate wherein the diaphragm and substrate are connected together. Optionally, the diaphragm and voice coil assembly are integrated. In some embodiments, the voice coil mount is supported by a spider.

Another aspect of the invention is a method of assembling an audio speaker comprising a frame, a magnet attached to the frame and having a magnetic field, a diaphragm attached to the frame, leads to electrically couple to a source of current, and a collar attached to the diaphragm, the collar being adapted to removably receive a voice coil assembly having a voice coil and maintain the voice coil in the magnetic field of the magnet, the method comprising attaching the voice coil assembly to the collar in a manner such that the voice coil assembly is user-removable. The act of attaching the voice coil assembly to the collar may complete an electrical connection between the voice coil and the leads. In some embodiments, the method further comprises an act of applying a fastener to the voice coil assembly and the collar. The act of applying the fastener may complete an electrical connection between the voice coil and the leads. Optionally, the act of attaching the voice coil centers the voice coil about the pole. In some embodiments, the act of attaching the voice coil includes applying fasteners which center the voice coil about the pole.

Another aspect of the invention is a method of servicing an audio speaker comprising a frame, a magnet attached to the frame and having a magnetic field, a diaphragm attached to the frame, leads to electrically couple to a source of current, and a collar attached to the diaphragm, the collar being removably attached to a first voice coil assembly that includes a first voice coil, the first voice coil being maintained in the magnetic field of the magnet, and the audio speaker being adapted to be electrically coupled to an amplifier, the method comprising detaching the voice coil assembly from the collar without destroying the diaphragm; and attaching a second voice coil to the diaphragm. The act of attaching the voice coil assembly to the collar may complete an electrical connection between the voice coil and the leads.

In some embodiments, the method further comprises an act of applying a fastener to the voice coil assembly and the collar. The act of applying the fastener may complete an electrical connection between the voice coil and the leads. The act of coupling the voice coil may center the voice coil about the pole.

In some embodiments, the method further comprises electrically connecting a second audio speaker to the first audio speaker, the first audio speaker and the second audio speaker electrically connected together, the first audio speaker and the second audio speaker adapted to electrically connect to the amplifier. Optionally, the first audio speaker and the second audio speaker may be electrically connected in series with one another. Alternatively, the first audio speaker and the second audio speaker may be electrically connected in parallel with one another.

BRIEF DESCRIPTION OF DRAWINGS

The accompanying drawings, are not intended to be drawn to scale. In the drawings, each like component is referenced by a like numeral. For purposes of clarity, every component may not be labeled in every drawing. In the drawings.

DETAILED DESCRIPTION

Figure 3A:
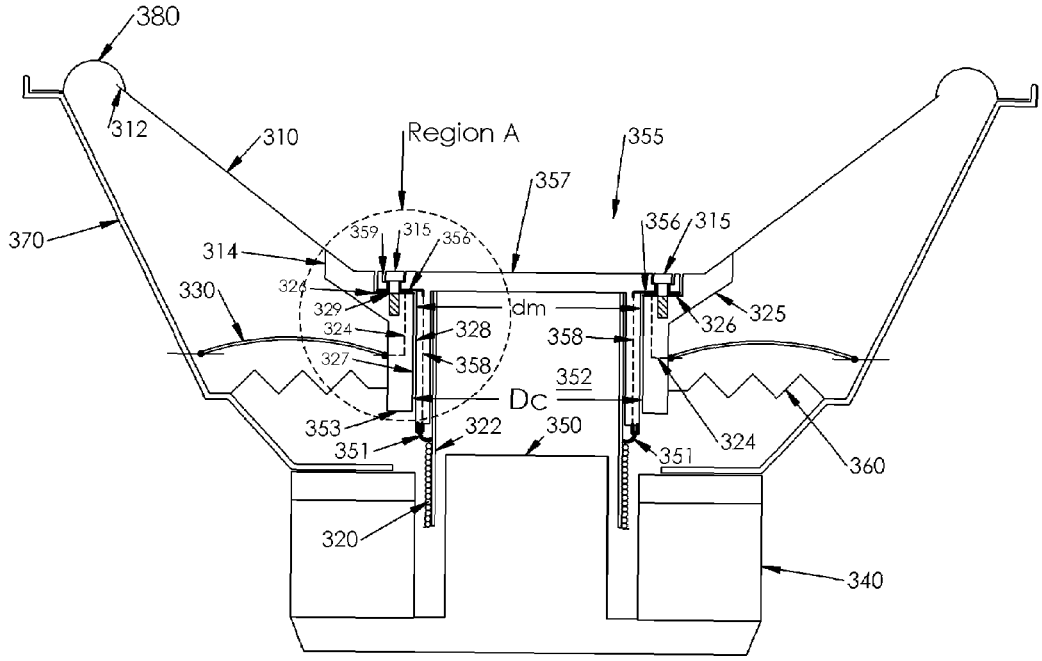
FIG. 3A is a cross-sectional side view of an embodiment of an audio speaker having a removably attached voice coil according to the present invention.

FIG. 3A is a cross-sectional side view of an embodiment of an audio speaker 300 having a removably attached voice coil 320 according to the present invention. Audio speaker 300 comprises a diaphragm 310, a magnet 340, a pole 350, a spider 360, a frame 370, and a voice coil assembly 355. (Voice coil assembly 355 is illustrated separately from the remainder of audio speaker 300 in FIG. 4, discussed below.) Frame 370, spider 360, pole 350, and magnet 340 may be conventional components and may operate in a conventional manner. The word "attachment" is defined herein to include direct attachment wherein a first object and a second object are affixed to one another, and indirect attachment wherein a first object and a second object are attached to one another using one or more intermediate objects.

Diaphragm 310 has an outer circumferential surface 312 that is attached to frame 370 through a surround 380 in a conventional manner, and an inner circumferential surface 314 attached to a collar 325. Diaphragm 310 may be any suitable diaphragm for producing an audio output and capable of being attached to collar 325.

Collar 325 is attached to diaphragm 310 and is adapted to detachably attach to voice coil assembly 355. In particular, surface 327 of collar 325 is adapted to slidably engage a voice coil assembly 355, such that the voice coil assembly 355 slides into an operable position.

Preferably, collar 325 is configured such that an attached voice coil assembly 355 is centered relative the pole 350 and magnet 340. Accordingly surface 327 may be centered relative to pole 350. In some embodiments, such as speaker system 300 illustrated in FIG. 3A, centering surface 327 is an inner surface of collar 325, like surface 327. However, the invention is not so limited and any suitable surface may be used to center voice coil 320 relative to pole 350 and/or magnet 340. For example, a collar may have a plurality of holes (not shown) through which fingers (not shown) on voice coil 355 protrude, such that an interior surface of the fingers contacts an outer surface of the collar.

Collar 325 has a fastening mechanism 329 (also illustrated in the expanded view of FIG. 3B discussed below). Fastening mechanism 329 may be a male or female fastening mechanism to work in coordination with a fastening mechanism 359 on voice coil assembly 355, such that collar 325 and voice coil assembly 355 are fastened together. In the illustrated embodiment, fastening mechanism 329 and fastening mechanism 359 are holes through which a faster 315 is attached. Fastener 315 mechanically fastens voice coil assembly 355 to collar 325 in a detachable manner. For example, fastener 315 may be a screw, bolt, rivet, dowel, pin, cotter pin, etc. However, the invention is not limited to those employing a fastener and any suitable fastening technique may be used to attach voice coil assembly 355 to collar 325.

For example, in some embodiments, the fastening mechanism may be comprised of an undersized diameter $D_C$ of centering surface 327 (i.e., diameter $D_C$ is undersized relative to diameter $d_M$ of surface 328) such that voice coil assembly 355 is press fit into collar 325. Alternatively, the fastening mechanism may enable voice coil assembly 355 to be snap fit together with collar 325. In snap fit embodiments, a fastening mechanism may include a leg (not shown) or other suitable snap fit feature to snap collar 325 to voice coil assembly 355. Alternatively, the fastening mechanism may be an appropriately located end 353 or other feature to which a snap fit leg (not shown) on voice coil assembly 355 may be attached. While collar 325 and diaphragm 310 may be separate components fastened together using any suitable technique (e.g., by applying an adhesive such as epoxy), in some embodiments, collar 325 is integrated with diaphragm 310 to form a single component Collar 325 includes electrical contacts 326 (also illustrated in the expanded view of FIG. 3B) such that when voice coil assembly 355 is properly located, electrical contacts 326 complete an electrical connection between voice coil 320 and leads 330. In some embodiments, a voice coil may be electrically polarized such that it is necessary selectively orient voice coil assembly 355 relative to collar 325 such that there is an electrical connection between a selected one of contacts 326 on collar 325 and a selected one of contacts 356 on voice coil assembly 355. In such embodiments, any suitable alignment mechanism may be used to achieve alignment. For example, collar 325 may have a groove (not shown) to operate in coordination with a protrusion (not shown) on the voice coil assembly 355 to permit selected orientation of the voice coil assembly.

Voice coil assembly 355 includes a voice coil 320, a substrate 322 about which voice coil 320 is wrapped, and an interface 357. Interface 357 has a surface 328 facing surface 327 of collar 325. Surface 327 may contact surface 328 to center voice coil assembly 355 relative to pole 355 and/or magnet 380. Alternatively, fastener 315 may center voice coil assembly 355 relative to pole 355 and/or magnet 380, such that contact between centering surface 327 and surface 328 is unnecessary.

Interface 357 may be any suitable structure adapted to removably attach to collar 325. In some embodiments, the attachment centers voice coil 320 with pole 350 and/or magnet 340. In some embodiments, interface 357 functions as a dust cover such that it forms a complete surface over region 352. While interface 357 and substrate 322 may be separate components fastened together using any suitable technique (e.g., by applying an adhesive such as epoxy), in some embodiments, interface 357 is integrated with substrate 322 to form a single component As described above, voice coil assembly 355 may include a fastening mechanism 359 to detachably fasten voice coil assembly 355 to collar 325. Fastening mechanism 359 may work in coordination with a fastening mechanism 329 on collar 325.

Voice coil 320 is electrically connected to a source of current (not shown) through leads 330 (e.g., conventional tinsel or tinned leads) to provide a suitable current signal to actuate diaphragm 310. In some embodiments, voice coil assembly 355 has conductive lines 358 integrated with substrate 322 to electrically connect to terminals 351 at ends of the voice coil 320. Collar 325 has conductive lines 324 to electrically connect leads 330 with contacts 326. In the illustrated embodiment, conductive lines 324 are integrated with collar 325 and run through collar 325, although the present invention is not so limited. Accordingly, when voice coil assembly 355 is properly positioned relative to collar 325, an electrical connection is made between voice coil 320 and leads 330.

It should be appreciated that any of leads 330, conductive lines 324, contacts 329, contacts 359, and conductive lines 358 can be constructed to have a selected impedance, such that the total impedance of these components has a selected value. Additionally, a selected impedance for any of these components may be achieved by an appropriate choice of material or dimensions of the component, or using any other suitable technique.

It should also be appreciated that the electrical connection between contacts 326 and contacts 356 in the illustrated embodiment is made by a simple, solder-free, mechanical contact. Moreover, in the illustrated embodiment, the lengths of leads 330 and lines 324 and 358 are fixed such that the combined impedance of entire electrical connection with the voice coil is determined. As a result, voice coil assembly 355 can be attached to collar 325, and an appropriate impedance can be reliably achieved without needing to select and/or solder a lead having a particular impedance such that the overall impedance of the electrical connection is met.

In some embodiments, fastener 315 may be electrically conductive, and may be configured and arranged such that it completes the electrical connection between contact 326 and contact 356. In such embodiments, a properly positioned voice coil assembly 355 may not make an electrical connection with collar 325, until fasteners 315 are added. Each of the fasteners 315 makes contact with a conductive line 324 and conductive line 358.

While removable voice coils were discussed with reference to standard speaker systems in which voice coil 320 and magnet 340 are behind diaphragm, it is to be appreciated that the invention may be implemented in inverted speaker systems in which the magnet and voice coil are arranged in front of a diaphragm.

Figure 3B:
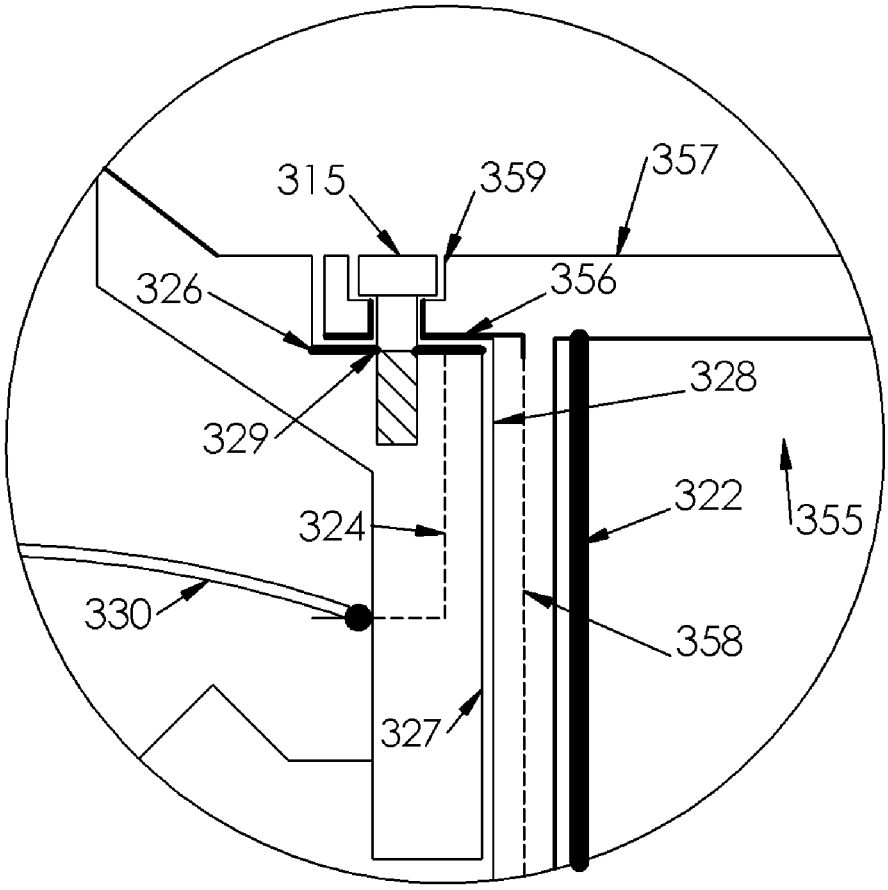
FIG. 3B is an expanded cross-sectional side view of Region A of FIG. 3B.

FIG. 3B is an expanded cross-sectional side view of Region A of FIG. 3A. FIG. 3B illustrates a continuous electrical connection between lead 330 and voice coil 320 (shown in FIG. 3A). The connection includes conductive line 324, contact 329, conductive line 358, and contact 356.

In the illustrated embodiment, because fastener 315 centers voice coil assembly 355 relative to pole 350 and magnet 340 (both shown in FIG. 3A), surface 328 of voice coil assembly 355 and surface 327 of collar 325 are not in intimate contact. However, as described above, in some embodiments, surface 328 and centering 327 may contact one another (e.g., the surfaces may be press fit together to attach the voice coil assembly 355 to collar 325, and/or contact between the surface may be used to center voice coil assembly 355 relative to pole 350 and/or magnet 340.

Figure 4:
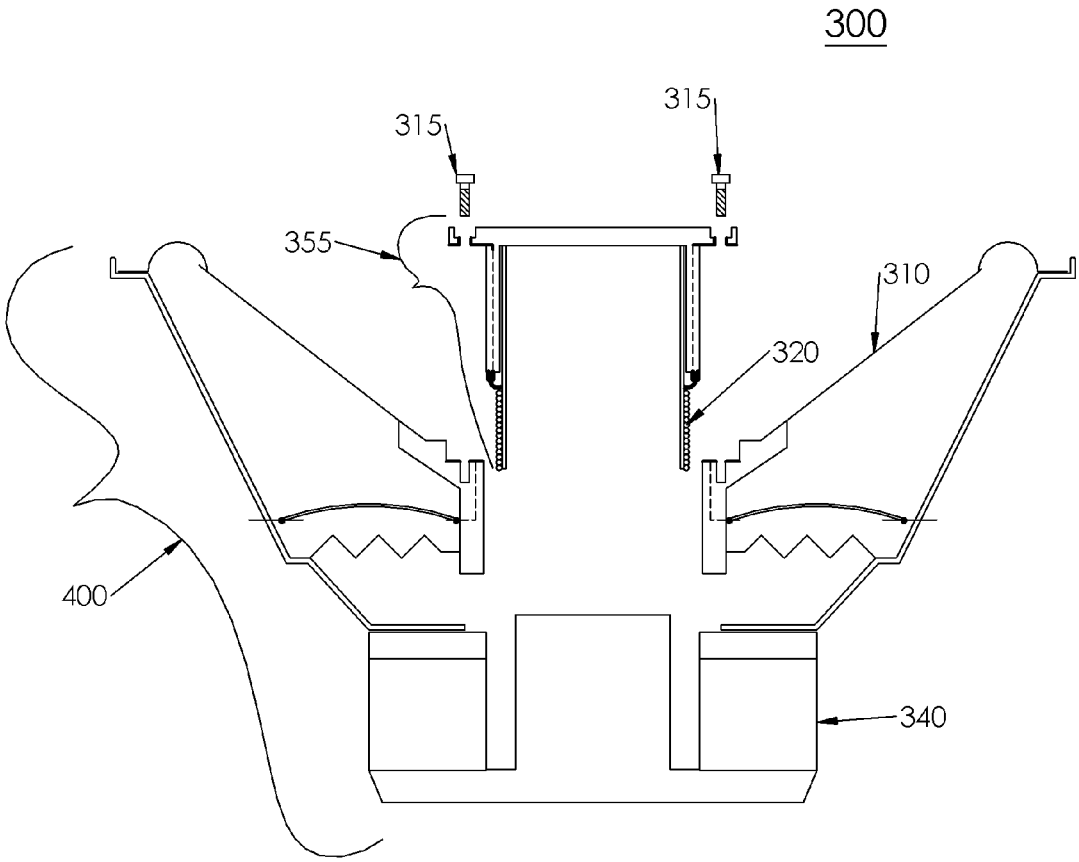
FIG. 4 is a cross-sectional side view, assembly diagram for an audio speaker having a removably attached voice coil according to the present invention.

FIG. 4 is a cross-sectional side view assembly diagram of audio speaker 300 having a removably attached voice coil 320 according to the present invention. Voice coil assembly 355 is illustrated as separated from audio speaker subassembly 400. Fasteners 315 are illustrated as separate from voice coil assembly 355 and audio speaker sub-assembly 400. It is to be appreciated that in the illustrated embodiment, the voice coil is removable from the front of the speaker (i.e., in the direction from which sound is projected from the speaker into the listening environment); however, the invention is not so limited and in some embodiments, the voice coil may be removable from the back of the speaker. It is further to be appreciated that in the illustrated embodiment, the voice coil assembly is removable such that when the voice coil assembly is removed, diaphragm 310 remains in place (contrast the embodiment illustrated in FIG. 6 below). Additionally, in some embodiments, voice coil 320 may be replaced with a replacement voice coil, such that all other components of a voice coil assembly 355 (i.e., all, excluding voice coil 320) may be used with the replacement voice coil. For example, a voice coil 320 may be attached to voice coil assembly 355 using a c-clamp or other suitable attachment technique to facilitate replacement of only the voice coil. Because all of the components of speaker 300 in FIG. 4 are the same as FIG. 3A above, no further discussion is provided.

Figure 5A:
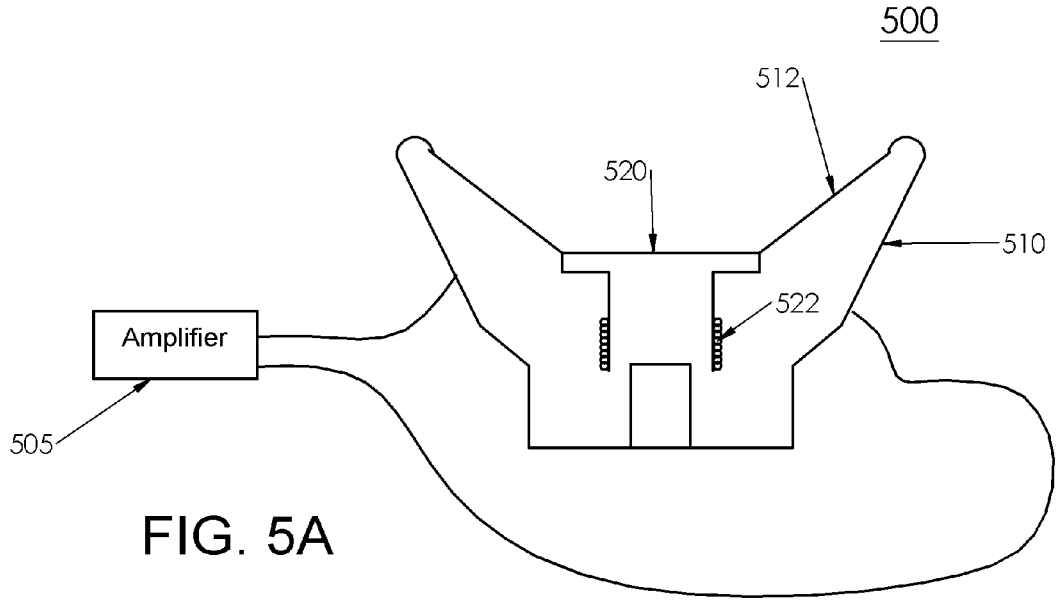
FIGS. 5A and 5B are schematic illustrations of speaker systems which, when taken together, illustrate an example of system reconfiguration according to the present invention.
Figure 5B:
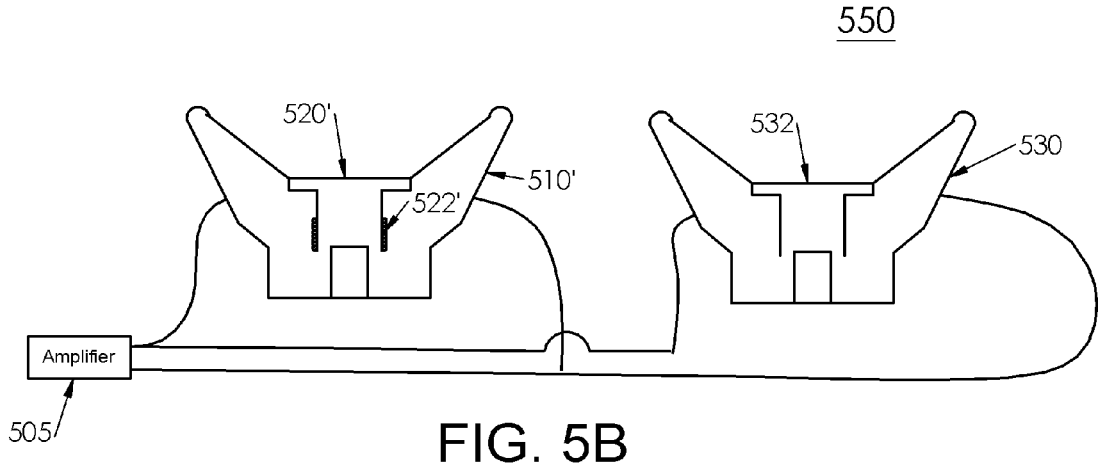

FIGS. 5A and 5B will be discussed in conjunction with one another to illustrate an example of system reconfiguration, which is facilitated by aspects of the present invention. FIGS. 5A and 5B are schematic illustrations of speaker systems 500 and 550, respectively. Speaker system 500, in FIG. 5A, includes an amplifier 505 which provides a current to a voice coil assembly 520, to actuate a diaphragm 512. Audio speaker 510 may be any audio speaker having a removable voice coil according to the present invention.

Speaker system 550 in FIG. 5B is a reconfiguration of speaker system 500 in FIG. 5A. Speaker system 550 includes the same amplifier 505. However, in speaker system 550, voice coil assembly 520 has been replaced by a voice coil assembly 520' to form an audio speaker 510', and a second audio speaker 530 having a voice coil 532 has been added, such that driver 505 drives both audio speaker 510' and audio speaker 530. While audio speaker 510' and audio speaker 530 are arranged to be in parallel, the invention is not so limited and speakers 510' and 530 may be arranged in series.

Audio speaker 510 (shown in FIG. 5A) is the same as audio speaker 510' except that they have different voice coil assemblies 520 and 520', respectively. Voice coil assemblies 520 and 520' need only be different in that voice coil 522 is different than voice coil 522' (i.e., the substrate and/or interface components may be the same). However, typically, they will have no components in common (i.e., the assembly is replaced in toto).

For example, amplifier 505 may be rated as a 4-ohm amplifier, and in FIG. 5A voice coil assembly 520 may have a 4-ohm impedance. In FIG. 5B the 4-ohm voice coil assembly 520 may be replaced by an 8-ohm voice coil assembly 520', and an additional audio speaker 530 having a 8-ohm voice coil assembly 532 may be added in parallel with audio speaker 510', such that the total impedance of voice coil assembly 520' and voice coil assembly 532 is 4 ohms. Alternatively, if speakers 520' and 530 were used in series, the 4-ohm voice coil 520 could be replaced by a 2-ohm voice coil assembly, and audio speaker 530 could be selected to have a 2-ohm impedance.

Figure 1:
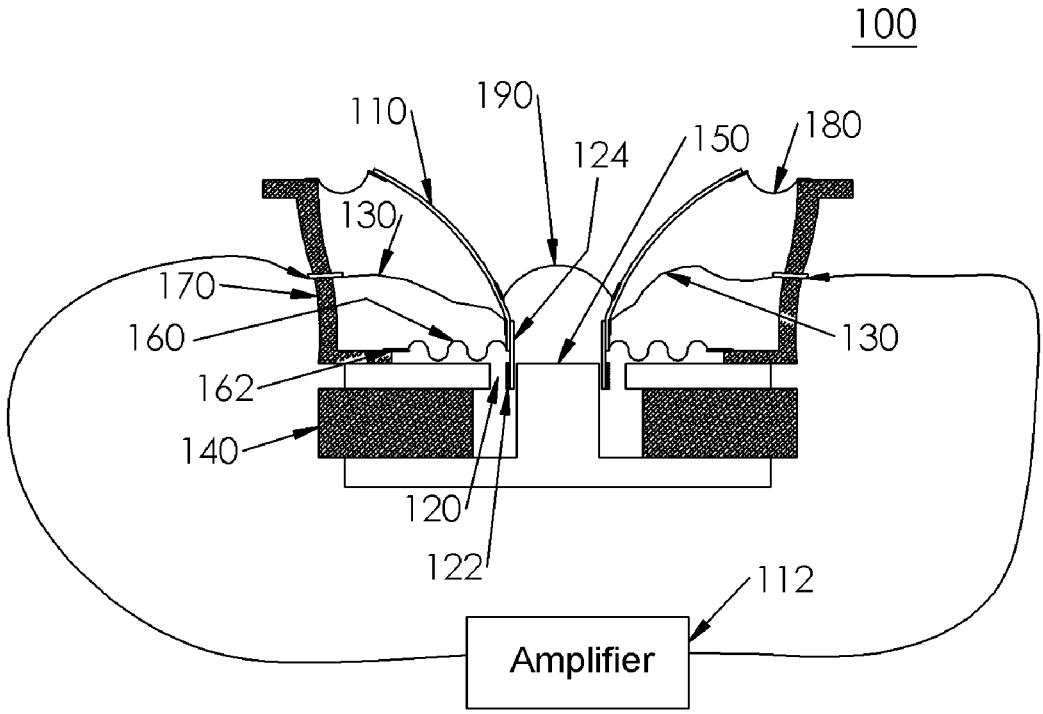
FIG. 1 (prior art)
FIG. 1 is a cross-sectional side view of a conventional audio speaker system having a diaphragm actuatable using a voice coil.
Figure 2:
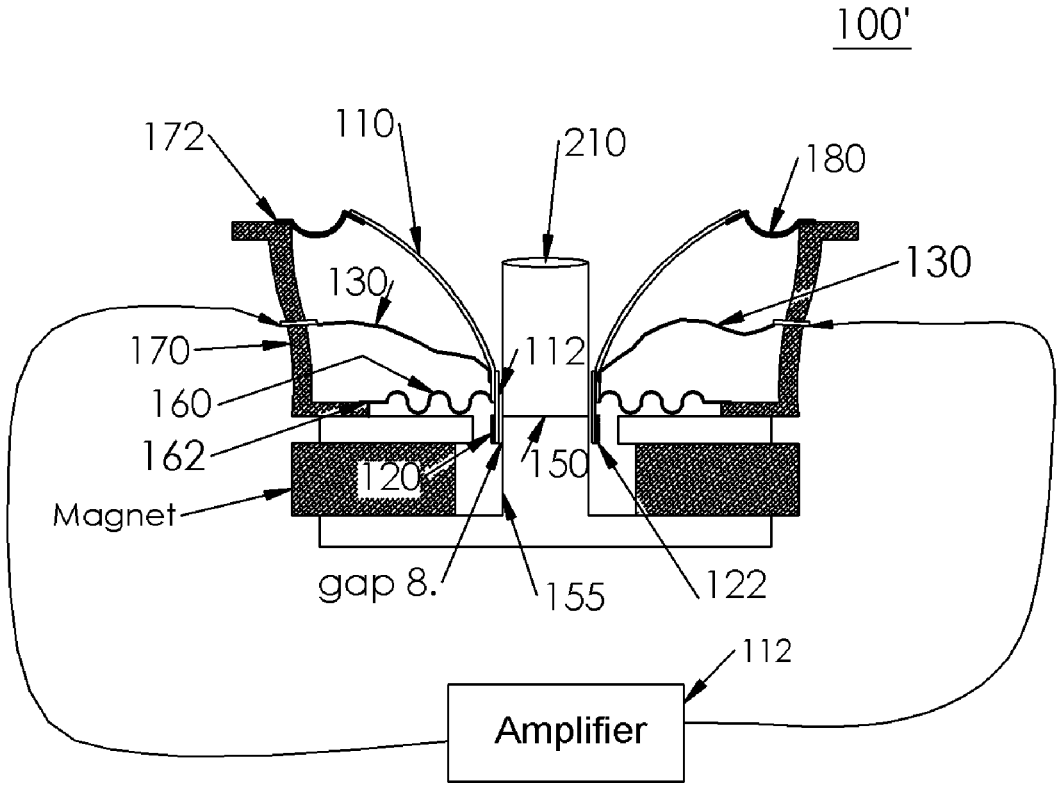
FIG. 2 (prior art)
FIG. 2 is a cross-sectional side view of a partially assembled conventional speaker system.

It is to be appreciated that reconfiguration of speaker system 500 to form speaker system 550 is facilitated by the fact that voice coil assembly 520 is removably attached to audio speaker 510 such that voice coil assembly 520 is removed and replaced with voice coil assembly 520' in audio speaker 510, as described above with reference to FIG. 2 (e.g., without a need to select and solder lead 130 and/or without the need to disassemble and reassemble audio speaker 510). Further, it is to be appreciated that reconfiguration of speaker system 500, to form speaker system 550, may be achieved at substantially reduced cost because voice coil assembly 520 is user-replaceable with voice coil assembly 520' without destruction of any components of audio speaker 510, whereas in a conventional speaker system, audio speaker 510 would typically be discarded in favor of a speaker system having an appropriate impedance.

Figure 6A:
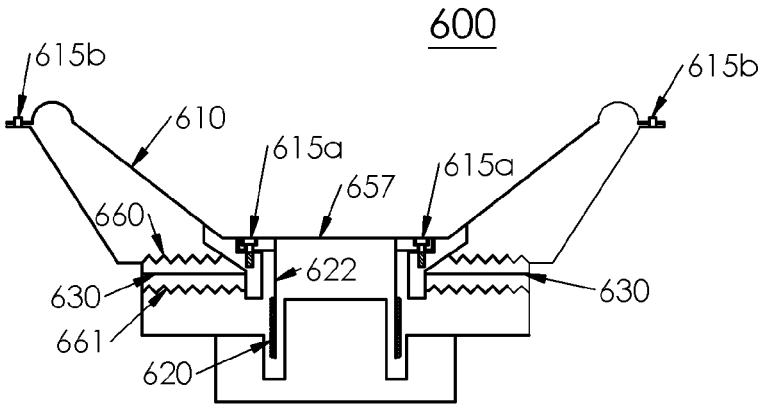
FIG. 6A is cross-sectional side view of an embodiment of an audio speaker having a removably attached voice coil according to the present invention, in which a diaphragm is removable along with voice coil.
Figure 6B:
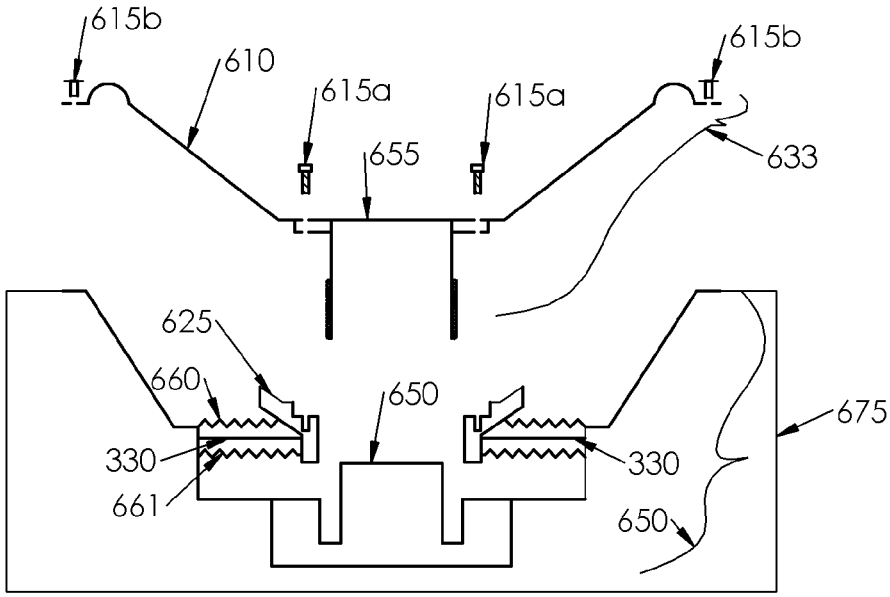
FIG. 6B is cross-sectional side view of the embodiment of an audio speaker of FIG. 6A in which the diaphragm and voice coil are removed

FIGS. 6A and 6B are cross-sectional side views of an embodiment 600 of an audio speaker having a removably attached voice coil 620 according to the present invention, in which a diaphragm 610 is removable along with voice coil 620. In FIG. 6B, the voice coil and the diaphragm are illustrated as removed. While embodiments in which a removable voice coil is removed along with a diaphragm may be less desirable in some circumstances due the additional component(s) that are removed and replaced (e.g., the diaphragm in addition to the voice coil), in other circumstances it may be desirable.

A first spider 660 may be used to support a voice coil mount 625 (e.g., a collar) in a position to receive diaphragm 610 and voice coil 620. In some embodiments, a second spider 661 may be added to add to the rigidity with which voice coil mount 325 is maintained. Voice coil mount 625 may operate as collar 325 in FIG. 3A above. For example, voice coil mount 625 may be centered about a pole 650. Leads 630 may be added to complete an electrical connection with voice coil 620. The electrical connection may be made as described above with reference to FIGS. 3A and 3B.

In some embodiments, diaphragm 610 and voice coil 620 are connected together to form a unit 633 such that they can be removed and/or attached together. The connection between diaphragm 610 and the voice coil 620 may be made using any suitable technique (e.g., a mechanical fastener or an adhesive). In some embodiments, diaphragm 610 is integrated with a substrate 622 and/or dust cap 657 of a voice coil assembly 655 (e.g., the diaphragm and the substrate and or dust cap form a single molded piece). It is to be appreciated that, while voice coil 620 mechanically drives diaphragm, diaphragm 610 need not be directly connected to voice coil assembly 620. For example, both voice coil assembly 655 and diaphragm 610 may be connected to voice coil mount 625.

The connection between unit 633 and audio speaker subassembly 600 may be made using any removable technique as described above. For example, first fastener(s) 615*a* to attach diaphragm 610 to subassembly 600, and second faster(s) 645*b* to attach dust cap 357 to subassembly 600. Preferably, both fasteners 615*a* and 615*b* are accessible from the front of the speaker such that subassembly may be removed from a cabinet (not shown) in which it may be mounted. In some embodiments, the fasteners attaching dust cap 357 to subassembly 600 may be accessible from the front by removing fastener 615*b* and physically bending diaphragm 610 out off the way. Other than the differences mentioned above, embodiment 600 is similar to embodiment 300 in FIG. 3 above.

This invention is not limited in its application to the details of construction and the arrangement of components set forth in the following description or illustrated in the drawings. The invention is capable of other embodiments and of being practiced or of being carried out in various ways. The use of "including," "comprising," or "having," "containing", "involving", and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the scope of the invention. Accordingly, the foregoing description and drawings are by way of example only.

What is claimed is:

1. An audio speaker, comprising:

a frame;

a diaphragm having an outer circumferential surface attached to the frame, and an inner circumferential surface; and a voice coil assembly comprising a voice coil and a substrate, about which the voice coil is wrapped, the voice coil assembly being user-removably attached the inner circumferential surface of the diaphragm, allowing the voice coil assembly to be removed from the audio speaker, and where the voice coil assembly is removable from the audio speaker without removal of the diaphragm.

2. The audio speaker of claim 1, further comprising a collar connected between the diaphragm and the voice coil assembly, the collar having an outer surface attached to the inner circumferential surface of the diaphragm, the collar adapted to removably receive the voice coil assembly.

3. The audio speaker of claim 2, wherein the voice coil assembly attaches to an interior surface of the collar.

4. The audio speaker of claim 3, wherein the collar is adapted to slidably engage the voice coil assembly.

5. The audio speaker of claim 2, further comprising a pole, wherein the collar has a surface centered relative the pole.

6. The audio speaker of claim 5, wherein the voice coil assembly mechanically contacts the surface and the voice coil is centered about the pole.

7. The audio speaker of claim 2, wherein the collar comprises a fastening mechanism.

8. The audio speaker of claim 7, wherein the collar is adapted to receive a fastener.

9. The audio speaker of claim 8, wherein the collar has an electrical contact attached thereto.

10. The audio speaker of claim 9, further comprising a fastener, wherein the fastener electrically connects the voice coil to the electrical contact.

11. The audio speaker of claim 7, wherein the fastening mechanism comprises one of a snap fit mechanism and press fit mechanism.

12. The audio speaker system of claim 9, wherein the collar has a conductive line electrically coupled to the electrical contact, and integrated with the collar.

13. The audio speaker of claim 3, wherein the voice coil assembly further comprises an interface attached to the interior surface of the collar, and attached to the substrate.

14. The audio speaker of claim 13, wherein the interface has at least one electrical contact attached thereto.

15. The audio speaker of claim 14, wherein the interface has a conductive line electrically coupled to the electrical contact, and integrated with the interface.

16. The audio speaker of claim 2, wherein the collar is integrated with the diaphragm.

17. An audio speaker subassembly, comprising:

a frame;

a diaphragm connected to the frame; and a collar connected to the diaphragm, the collar being adapted to removably receive a voice coil assembly, wherein the voice coil assembly comprises a voice coil and is user-removably attached to the collar, allowing the voice coil assembly to be removed from the audio speaker subassembly, and where the voice coil assembly is removable from the audio speaker assembly without removal of the diaphragm.

18. The audio speaker subassembly of claim 17, wherein the collar is adapted to slidably engage the voice coil assembly.

19. The audio speaker subassembly of claim 17, further comprising a pole attached to the frame, wherein the collar has a centering surface centered relative the pole.

20. The audio speaker subassembly of claim 17, wherein the collar comprises a fastening mechanism.

21. The audio speaker subassembly of claim 20, wherein the fastening mechanism is adapted to receive a fastener.

22. The audio speaker subassembly of claim 20, wherein the fastening mechanism is one of a snap fit mechanism and press fit mechanism adapted to fasten the voice coil assembly.

23. The audio speaker subassembly of claim 18, wherein the collar includes at least one electrical contact attached thereto adapted to electrically connect to the voice coil.

24. The audio speaker subassembly system of claim 23, wherein the collar has a conductive line electrically connected to the contact, and integrated with the collar.

25. The voice coil assembly of claim 17, wherein the collar is integrated with the diaphragm.

* * * * *